US007614184B2

(12) United States Patent
Rebel et al.

(10) Patent No.: US 7,614,184 B2
(45) Date of Patent: Nov. 10, 2009

(54) OPERATOR FOR CASEMENT TYPE WINDOW

(76) Inventors: Jacob Rebel, 4353 Callaghan Crescent, Abbotsford, British Columbia (CA) V3G 2Z1; Hong Chen, 15256 94th Avenue, Surrey, British Columbia (CA) V3R 1E3

( * ) Notice: Subject to any disclaimer, the term of this patent is extended or adjusted under 35 U.S.C. 154(b) by 423 days.

(21) Appl. No.: 11/004,126

(22) Filed: Dec. 6, 2004

(65) Prior Publication Data

US 2006/0053692 A1 Mar. 16, 2006

(30) Foreign Application Priority Data

Aug. 26, 2004 (CA) ..... 2479176

(51) Int. Cl.
*E05F 11/28* (2006.01)

(52) U.S. Cl. ..... 49/345; 49/339; 74/89.14; 74/425

(58) Field of Classification Search ..... 49/339, 49/340, 341, 345, 324, 342, 343, 346; 74/606 R, 74/89.14, 425
See application file for complete search history.

(56) References Cited

U.S. PATENT DOCUMENTS 2,926,399 A * 3/1960 Ramunas ..... 49/248
2,926,905 A * 3/1960 Ahlgren ..... 74/89.13
3,422,575 A * 1/1969 Armstrong ..... 49/356
4,143,556 A * 3/1979 Hauber ..... 74/25
4,938,086 A * 7/1990 Nolte et al. ..... 74/89.14
5,435,103 A * 7/1995 Lauesen et al. ..... 49/386
5,937,582 A * 8/1999 Taylor ..... 49/341
6,044,587 A 4/2000 Vetter et al.
6,122,863 A * 9/2000 Tippin et al. ..... 49/279
6,128,858 A 10/2000 Vetter et al.
6,247,270 B1 * 6/2001 Huml ..... 49/341
6,314,681 B1 11/2001 Moody
6,634,141 B2 10/2003 Anderson et al.
7,278,335 B2 * 10/2007 Zhang ..... 74/425
2004/0216381 A1 * 11/2004 Clavet ..... 49/342

* cited by examiner

*Primary Examiner*—Gregory J. Strimbu
(74) *Attorney, Agent, or Firm*—Frederick Kaufman

(57) ABSTRACT

An operator comprising a housing ending in a flange is provided with a turret incorporating a stepped bore for locating a worm shaft of a drive mechanism. A first seal is disposed between the worm shaft and the stepped bore. A second seal is interposed between the flange and a frame of a window. An interconnecting mechanism driven by the worm shaft comprises a pair of worm arms followed by a pair of links. The former and the latter are provided with male and female ends using, respectively, a calotte of a sphere complemented by a spherical shaped recess. Thus, between the pair of worm arms and the pair of links, pivotal joints are formed.

4 Claims, 8 Drawing Sheets

OPERATOR FOR CASEMENT TYPE WINDOW

I. BACKROUND OF THE INVENTION

1. Field of the Invention

The present invention relates generally to the field of window operators. More specifically, it relates to an operator for casement type window that substantially contributes to the sealing capacity of the windows against water attempting to infiltrate from the outside area into the building. The present invention relates as well to an operator for casement type window that allows a main joint of its interconnecting mechanism to work adequately in a non planar way.

2. Description of the Prior Art

The use of window operators for casement type windows is common in today's construction. It is known, that one of the major problems in house construction is that of preventing the leakage of water from the exterior of the house. Among other functions, window operators for casement type window must accomplish the important function of barrier to moisture and water infiltration.

It is also known, that in casement type windows the sash must be operated to swing back and forth by using the arms and links of its interconnecting mechanism to spread out or gather in. Between the arms and the links, a pivotally joint having a big clearance between the axle and the hole, to allow the joint to work in a non planar way, is usually used. This type of joint generates a non uniform and increased friction; the components wear faster and, consequently, affect negatively the smoothness of operation, reliability and service life of the joint.

Several patents have addressed the issue of improving window operators.

The following disclosures relate to various types of window operators:

Dallas, et al (U.S. Pat. No. 6,672,010, issued Jan. 1, 2004); Van Klompenburg, et al (U.S. Pat. No. 6,640,389, issued Nov. 4, 2004); Nobuyushi (JP Published Appl. No. 2003184402, published Jul. 3, 2003); Dawson (U.S. Published application No. 20030110701, published Jun. 19, 2003); Toshio (JP Published Appl. No. 2003155866, published May 30, 2003); Sullivan (WO No. 03042479, published May 22, 2003); Van Klompenburg, et al (U.S. Published application No. 20020066162, published Jun. 6, 2002); Anderson, et al. (U.S. Pat. No. 6,385,911, issued May 14, 2002); Frederick (U.S. Pat. No. 6,374,544, issued Apr. 23, 2002); Huml (U.S. Pat. No. 6,247,270, issued Jun. 19, 2001); Taylor (U.S. Pat. No. 5,937,582, issued Aug. 17, 1999); Sheets, et al. (U.S. Pat. No. 5,815,984, issued Oct. 6, 1998); Vetter, et al (U.S. Pat. No. 5,493,813, issued Feb. 27, 1996); and Nolte, et al (U.S. Pat. No. 4,938,086, issued Jul. 3, 1990).

The applicant believes that the cited disclosures, taken alone or in combination, neither anticipate nor render obvious the present invention. The foregoing citations do not constitute an admission that such disclosures are relevant or material to the claims. Rather the disclosures are related to the field of the invention and are cited as constituting the closest art of which the applicant is aware.

II. SUMMARY OF THE INVENTION

Based on state of the art in the field of window operators for casement type window, there is a need of improving the existing types of operators.

It is a first objective of this invention to provide an operator for casement type window that eliminates or at least alleviates the leakage due to mist and water infiltration.

It is a second objective of the present invention to devise a window operator with an interconnecting mechanism with fit joints that provides a smooth functioning and allows the extremities of its arms and links to move along a more variable trajectory. Thus, the operator could be more versatile, i.e. to fit to more windows with different sizes.

Broadly describing, the operator for casement type window comprises a housing attachable to a frame;

a drive mechanism, generally disposed in the housing;

an interconnecting mechanism; and an attachment fixture securable to a sash.

The drive mechanism and the attachment fixture is conveniently joined via the interconnecting mechanism.

The housing comprises a body with a pair of parallel walls closed at a top and ending at a bottom with a flange perpendicular to the pair of parallel walls. A cavity with a pair of internal parallel surfaces is formed in an interior of the body, the flange having, at an end of the pair of parallel surfaces, a pair of consecutive slots. A pair of guiding walls extends outwardly and longitudinally from each side of the center of symmetry of the flange and flanks one slot of the pair of consecutive slots. Thus, two consecutive channels are formed. Each one of the two consecutive channels is situated between one pair of the two pairs of guiding walls and the pair of internal parallel surfaces. A first means for sealing is disposed in a continuous groove extending adjacent to and around a periphery of the flange. A turret, inclined with respect to the flange and projecting outwardly from one of the pair of parallel walls, is provided with a stepped bore having successively decreasing diameters and inclined slots for communicating with the cavity.

The drive mechanism includes a worm shaft inserted with a clearance fit into the stepped bore, a portion of the worm shaft, corresponding to its largest diameter, is provided with a notch for locating a second means for sealing. Thus, a barrier preventing a water or mist infiltration between the worm shaft and the stepped bore, from beneath to above the second means of sealing is created.

The interconnecting mechanism basically comprises a left and right worm gear means, pivotally secured to and located partially in the housing wherein they engage the worm shaft, and interconnected outside the housing with a left and right link, both being further pivotally secured to a closing link.

Both the left and right worm gear arms terminate at one extremity in a worm gear, namely a segment of the latter, drivably engaged with the worm shaft, and at an opposite extremity—in a male or female end. When one link of the left and right link terminates, at an extremity adjacent to the left and right worm gear arms, in a female end, one arm of the left and right worm gear arms extends outside said housing into a male end. The female end complements the male end and forms together a pivot and, obviously, vice versa when said one link terminates in a male end.

In one aspect of this invention, the housing further comprises a base commensurate lengthwise with the flange and is provided with a guiding slot generally coextensive with the pair of consecutive slots, the body and the base being adapted to sandwich a frame of a window. Between the body and the frame is disposed the first means for sealing that includes an O-ring seal.

In another aspect of the present invention, the portion of the shaft worm with the largest diameter is supported in the stepped bore by a shoulder formed at a transition between two successive diameters. The shaft worm includes as well a worm zone and a guiding-retaining zone, the last zone being inserted into the last part of the stepped bore. The guiding-retaining zone extending past an end of the stepped bore wherein it is provided with an annular indentation for locating a retaining ring, whereby the worm shaft is enabled only to rotate, any axial movement being prevented by the shoulder and the retaining ring.

In yet another aspect of the present invention, the male end of at least one arm of the left and right worm gear arms and the male end of at least one link of the left and right links are each similar to a calotte of a sphere. The female end of at least one arm of the left and right worm gear arms and the female end of at least one link of the left and right links are each similar to a spherical shaped recess that is complementary to the calotte of a sphere.

The male end is provided with a centrally located first stepped passage having a diameter generally larger than a diameter of a second stepped passage centrally located in the female end. The first stepped passage has at its entrance, that is oppositely located relative to a contact zone between the calotte of a sphere and the spherical shaped recess, a spherical indentation. The second stepped passage has at its exit, which is also oppositely located relative to the contact zone between the calotte of a sphere and the spherical shaped recess, a chamfered zone. A stepped rivet is provided with a spherical head to fit into the spherical indentation and has a larger diameter, for passing with a clearance through the first stepped passage, and a relatively smaller diameter for close fit into the second stepped passage, whereby when the stepped rivet is used to assembly one male end with one of female end, an end of the stepped rivet that protrudes from the stepped passage is upset; the chamfered zone is filled with a closing end of the stepped rivet, so that a relative movement between the male end, respectively the calotte of sphere, and the female end, respectively the spherical shaped recess is always possible.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

IV. DESCRIPTION OF A PREFERRED EMBODIMENT

Figure 1:
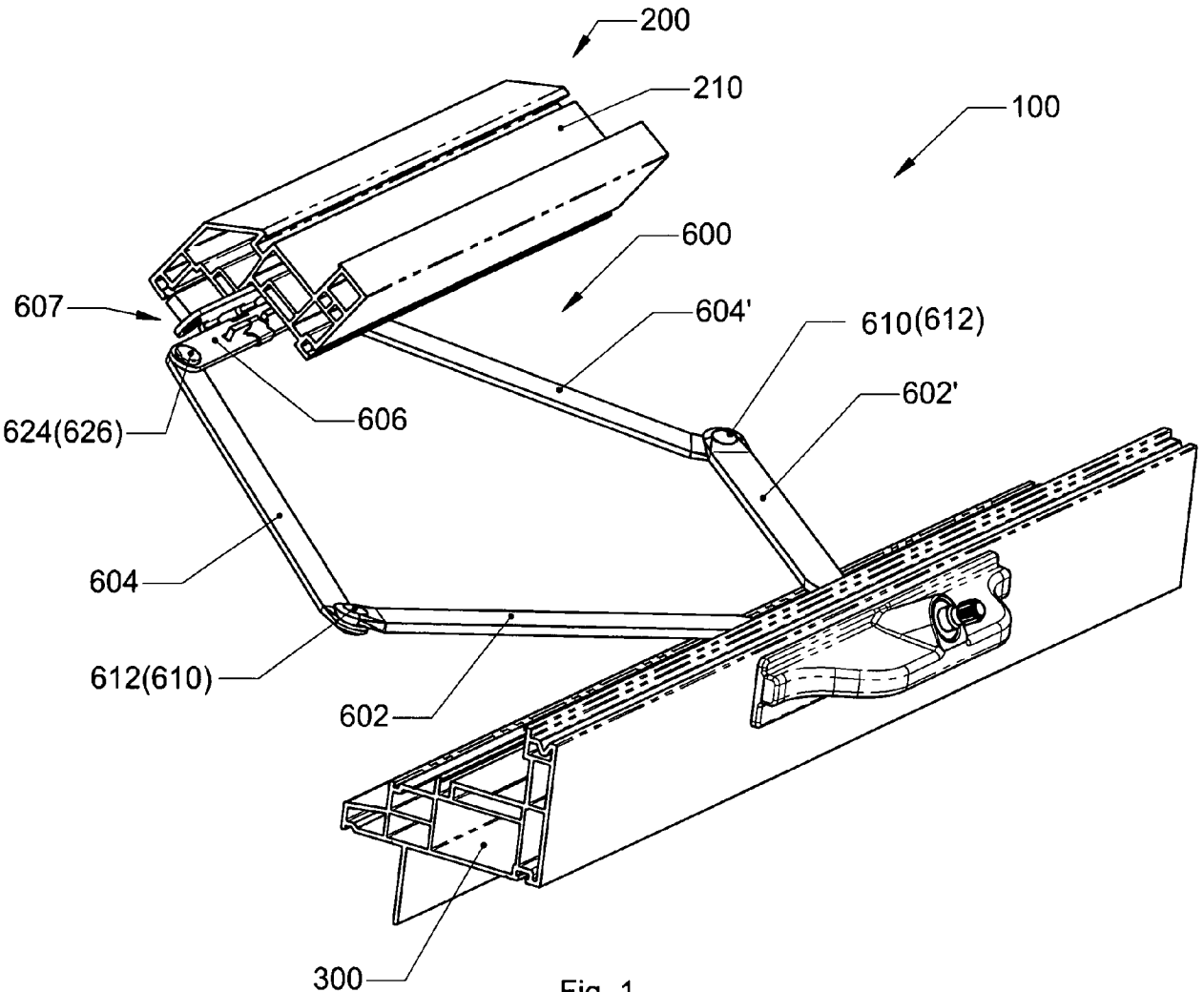
FIG. 1 illustrates a perspective view of an operator for casement type window mounted to a frame and a sash.
Figure 1A:
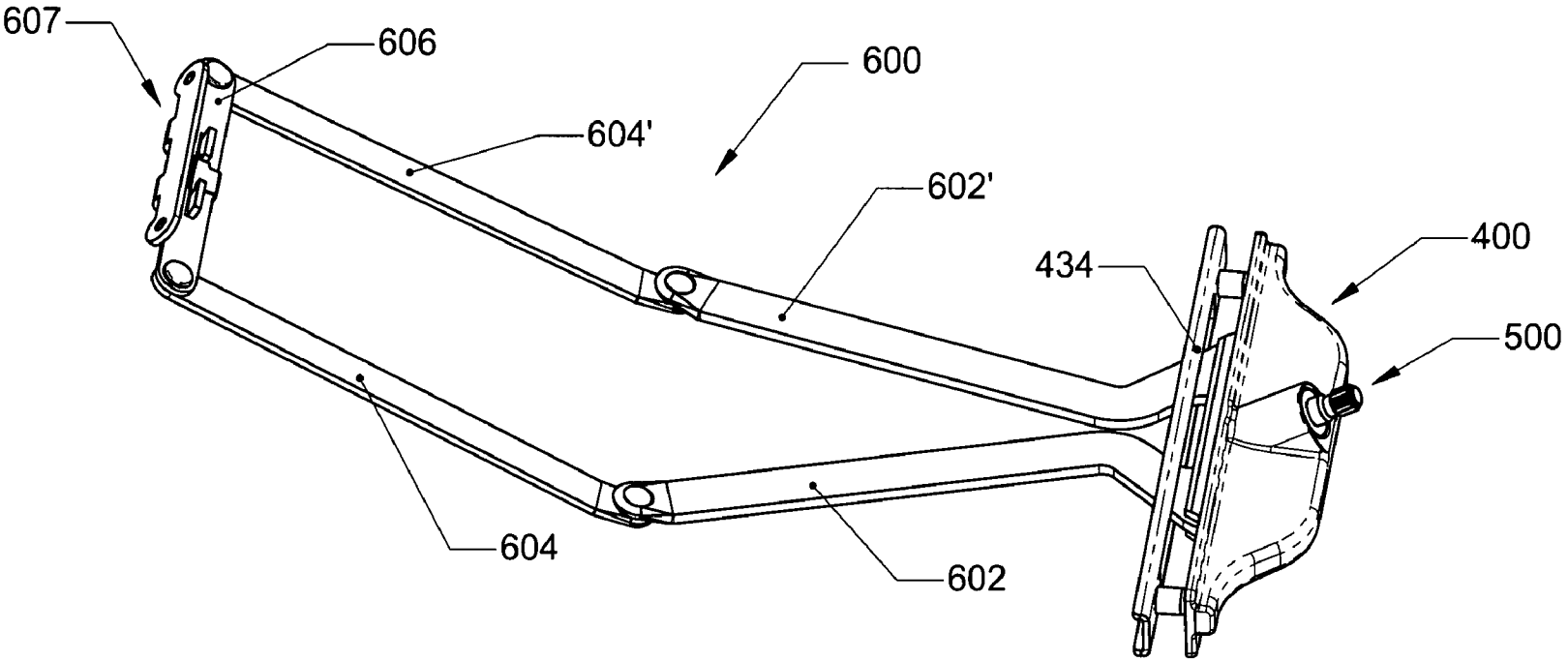
FIG. 1A illustrates the operator of FIG. 1 per se.
Figure 2:
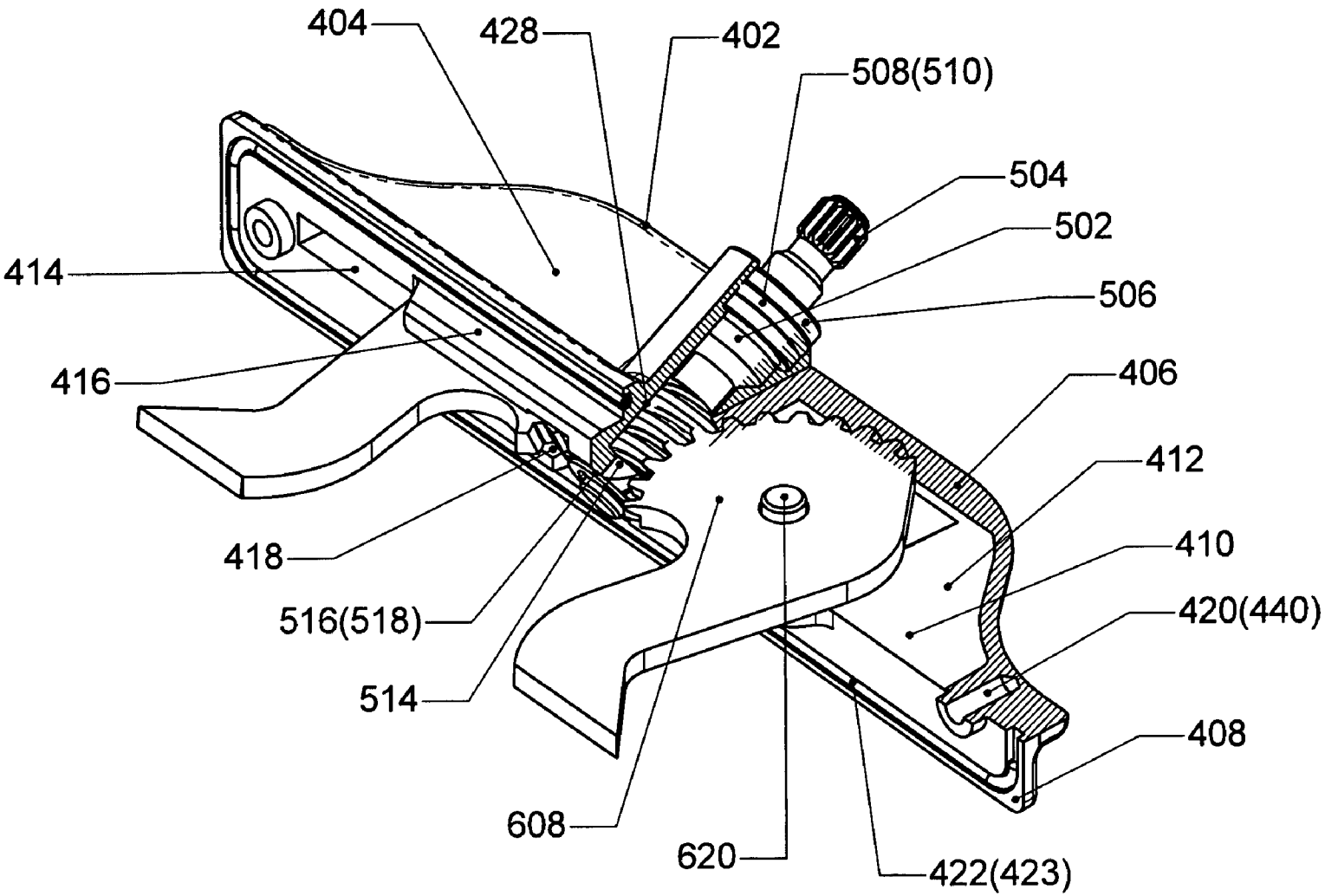
FIG. 2 illustrates a perspective partially cut-away view of operator's housing with a drive mechanism within.
Figure 2A:
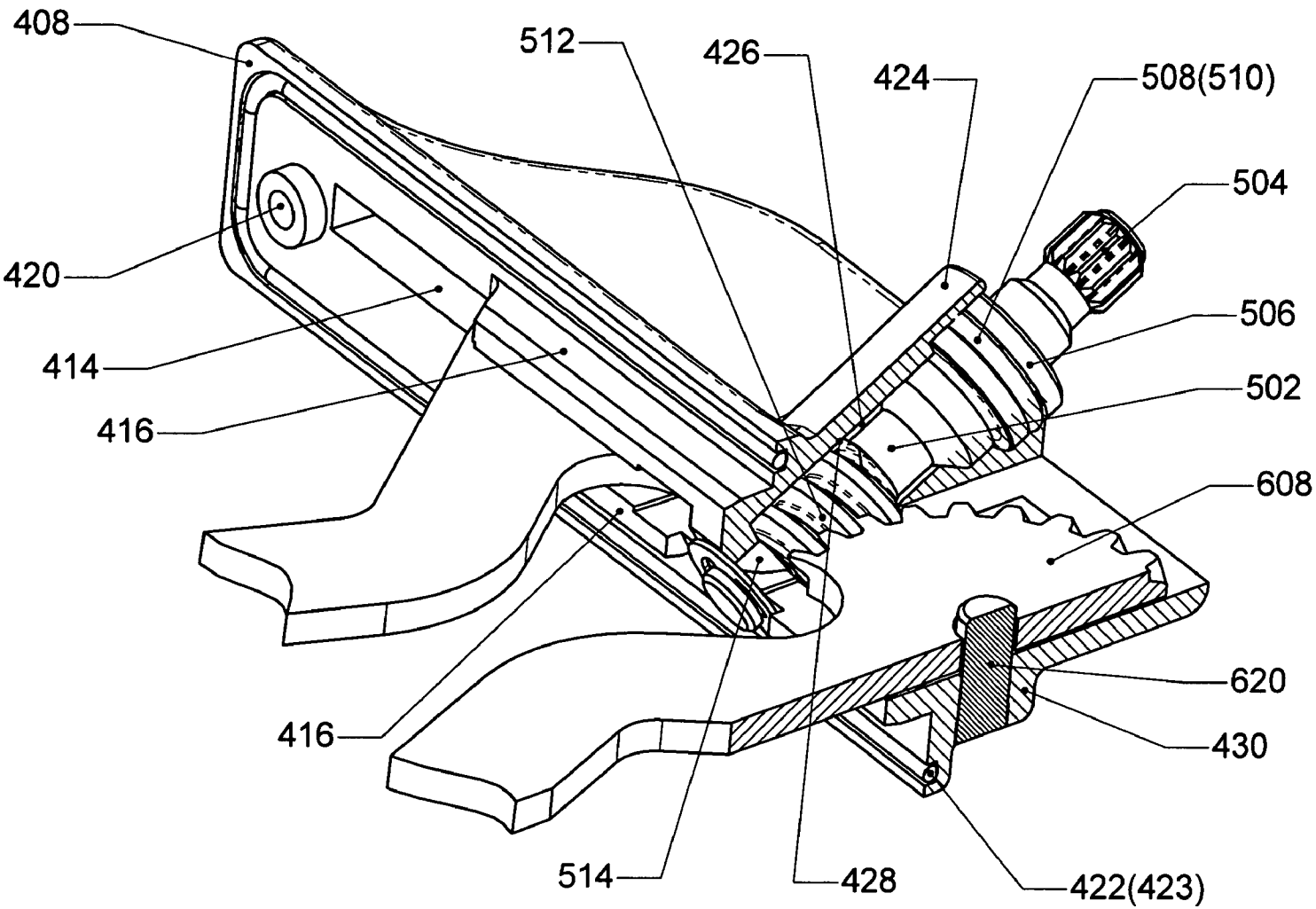
FIG. 2A illustrates a view similar to FIG. 2 but showing parts not visible in the latter.
Figure 3:
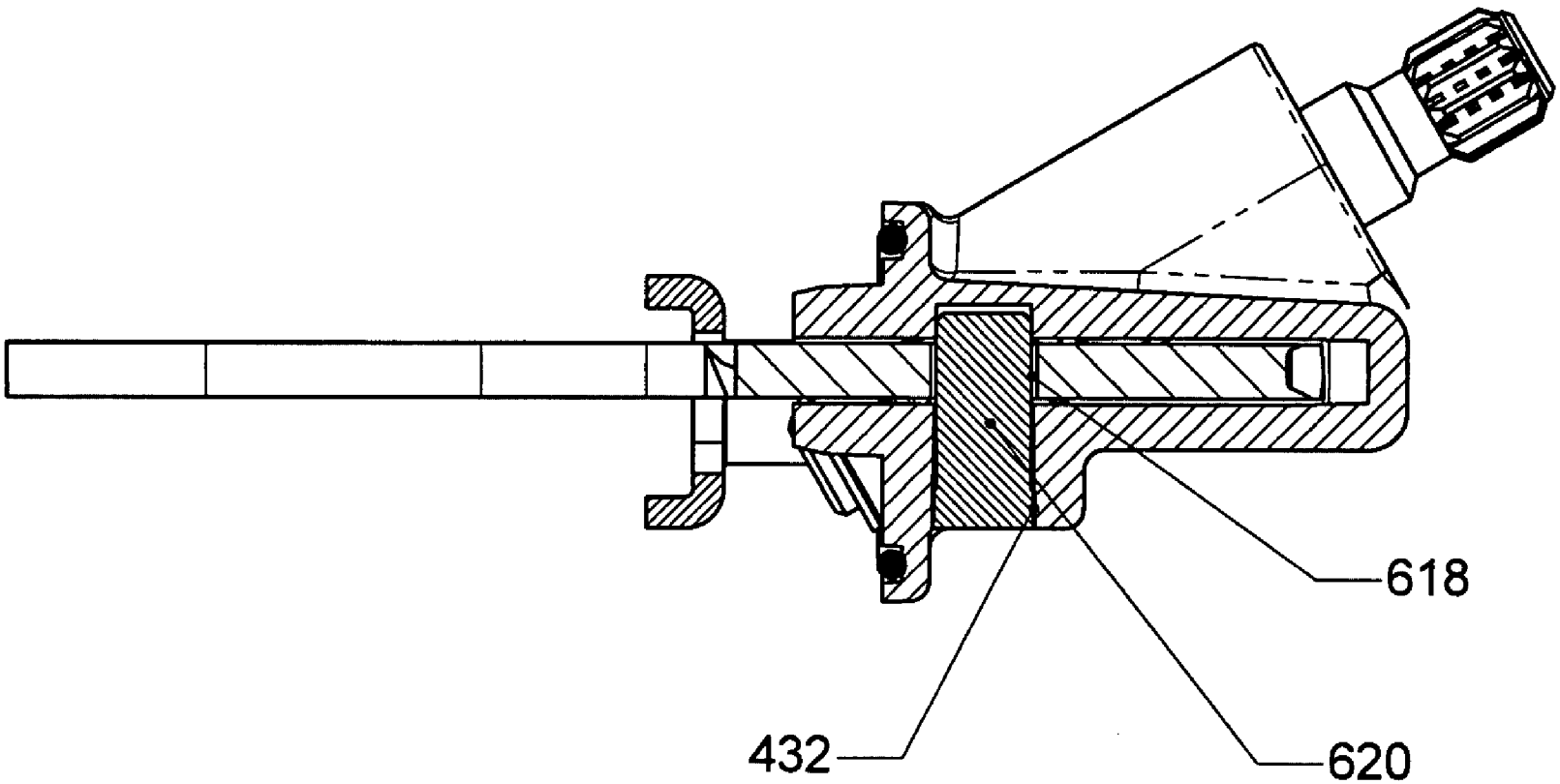
FIG. 3 illustrates a sectional vertical view through the housing, respectively along a body of the housing, a worm gear and a pin around which the latter pivots.
Figure 4:
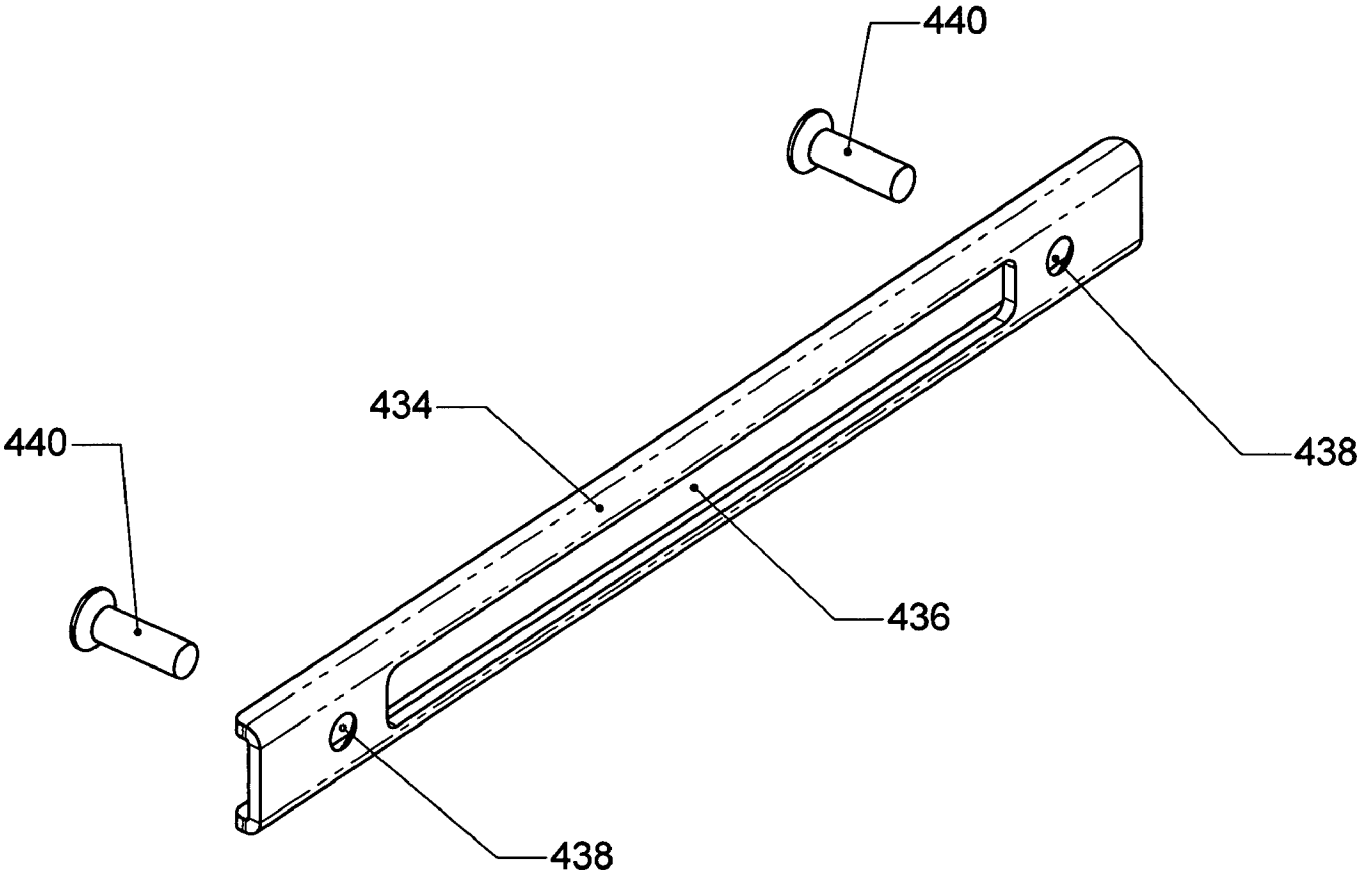
FIG. 4 illustrates a base; the base together with the body of the housing captures a portion of the frame, sandwiched between the former and the latter.
Figure 5:
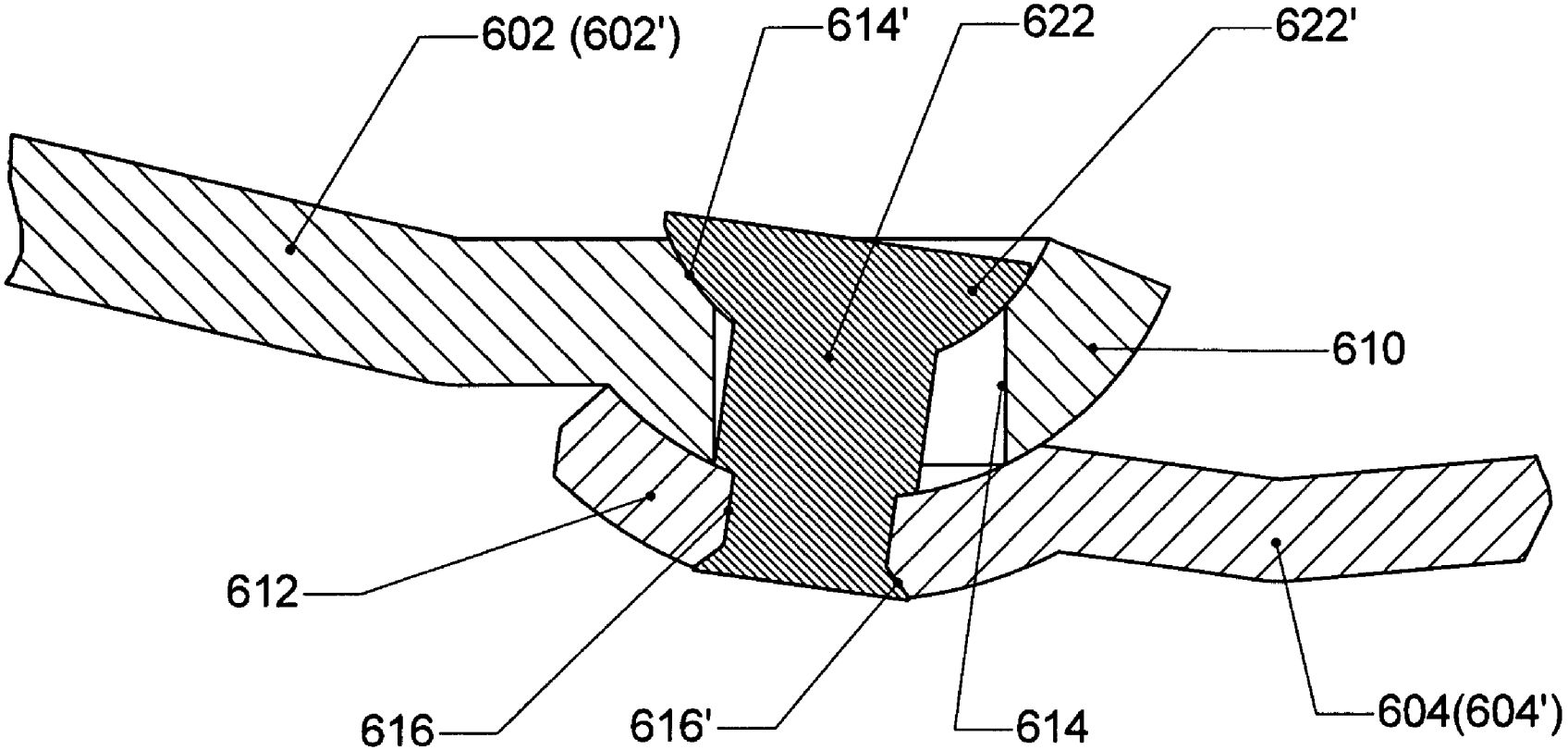
FIG. 5 is a detail vertical sectional view showing a calotte of a sphere constituting a male end of either a left or right worm gear arm or either a left or right link associated with and complementary to a female spherical shaped recess end of either a left or right worm gear arm or either a left or right link.
Figure 6:
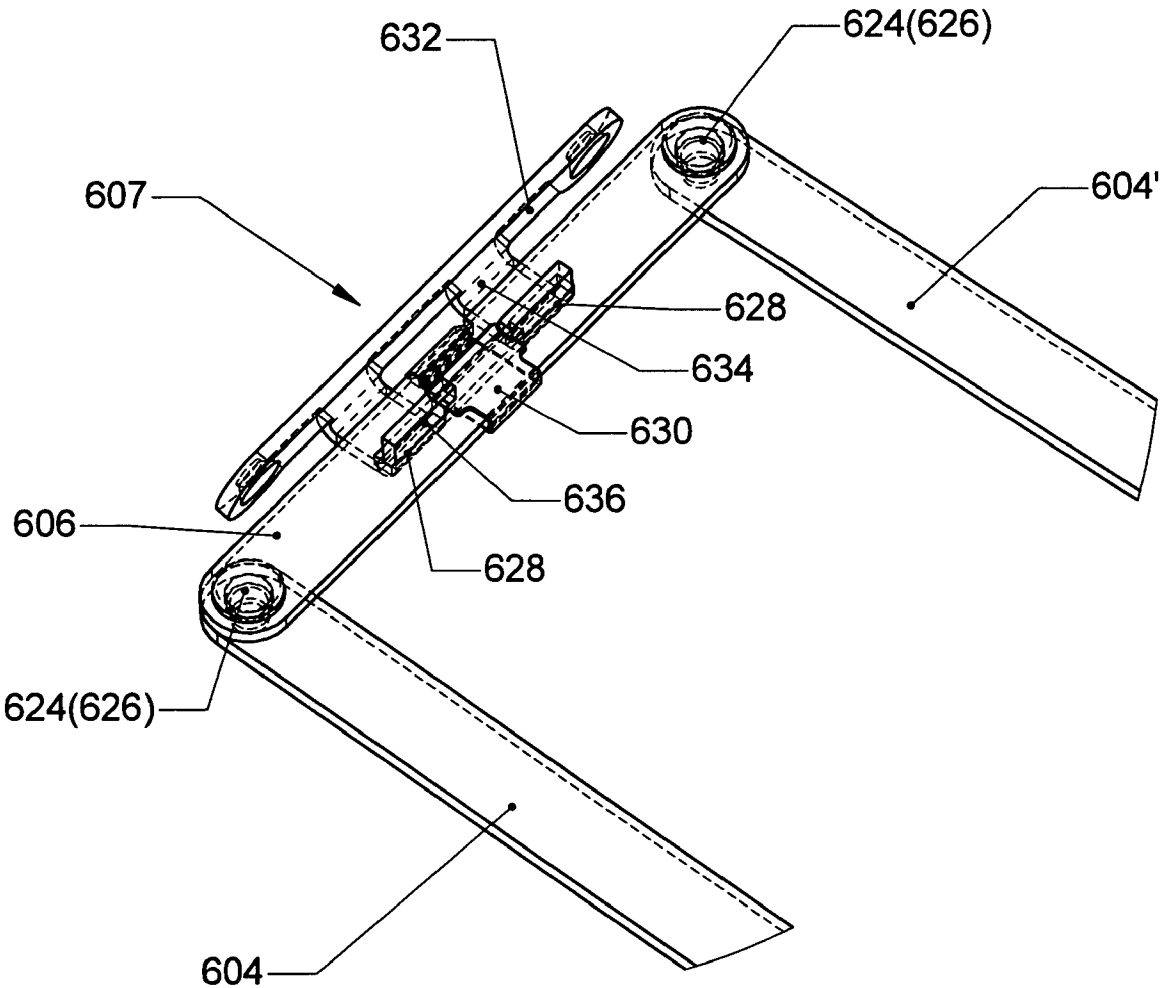
FIG. 6 illustrates an attachment fixture securable to the sash.

FIGS. 1-6 illustrate an operator for casement type window 100 adaptable for controlling the movement of a sash 200 relative to a frame 300 mounted into an opening of a building. Sash 200 is openable outwardly (extended position), or closable inwardly (stored or retracted position) and has a first edge (not shown), pivotally attached to frame 300 by means of hinges (not shown), and a second edge 210, oppositely disposed with respect to the first edge.

Operator for casement type window 100 is located on and firmly secured to frame 300, oppositely to second edge 210 (when sash 200 is in closed position), and is also connected to the latter.

Operator for casement type window 100 is of remote controlled type and includes:

- a housing 400 attachable to frame 300;
- a drive mechanism 500, generally disposed in housing 400;
- an interconnecting mechanism 600;
- an attachment fixture 607 securable to sash 200, respectively to its second edge 210;
- drive mechanism 500 and attachment fixture 607 being conveniently joined via interconnecting mechanism 600.

Housing 400 comprises a body 402 having a one-piece, elongated structure of channel type, which incorporates a pair of parallel walls 404 ending at one side with a closing wall 406 perpendicular to the latter. A flange 408 is located perpendicularly to the pair of parallel walls 404. A cavity 410, having a pair of internal parallel surfaces 412, is formed in the interior of body 402. Flange 408 is provided, partially along its length, at the end of the pair of internal surfaces 412, with a pair of consecutive slots 414. A pair of guiding walls 416 extends outwardly and longitudinally from each side of the center of symmetry of flange 408 and flanks one slot of the pair of consecutive slots 414. Thus, two consecutive channels 418 are formed, each channel 418, being situated between one pair of guiding walls 416, continues into one zone of the pair of internal parallel surfaces 412. One threaded blind-hole 420 is disposed contiguously to each longitudinal extremity of flange 408. A continuous grove 422, extending adjacent to and around a periphery of flange 408, is used to locate a first 423 O-ring seal. Threaded blind-holes 420 extend outwardly somewhat past flange 408, while the two pairs of guiding walls 416 extend also outwardly, but farther than threaded-blind holes 420.

A turret 424, inclined approximately at 600 with respect to flange 408, respectively to a planar surface of the latter, projects outwardly from one of the pair of parallel walls 404. Turret 424 is so situated with respect to frame 300, that drive mechanism 500, mostly located within turret 424, could be actuated from an outside location corresponding to the interior of a building. Turret 424 incorporates a stepped bore 426 having three successively decreasing diameters. A portion of a wall of turret 424, corresponding to cavity 410 is traversed by a pair of inclined slots 428, disposed oppositely to each other. Thus, stepped bore 426 communicates with cavity 410.

One of the walls of the pair of parallel walls 404, oppositely located with respect to the other wall of the same pair of parallel walls 404, from which turret 424 projects outwardly, has a protruded zone 430. The latter is parallel to its adjacent parallel wall 404 and terminates at flange 408. A pair of perforations 432, equally disposed with respect to a transversal axis of symmetry of flange 408, is drilled throughout protruded zone 430 and its adjacent parallel wall 404, and penetrates partially into opposed parallel wall 404.

A base 434 constitutes, as well as body 402, a component of housing 400. Base 434 is of channel structure and is, approximately, commensurate in length with flange 408. Base 434 is provided with a guiding slot 436 coextensive in length with the pair of consecutive slots 414 and somewhat wider than the latter. A pair of counter bored apertures 438 is located in base 434. To mount body 402 and base 434 to a frame 300 that is sandwiched between the former and the latter, a pair of countersunk head screws 440 is inserted into the pair of counter bored apertures 438, traverses frame 300 and is tightened in threaded blind-holes 420.

Drive mechanism 500 includes a worm shaft 502 having first a serrated zone 504 extending out from stepped bore 426 of turret 424. Serrated zone 504 is adapted to be used with a crank handle (not shown) for imparting movement in worm shaft 502. The latter has, as well, a zone of large diameter 506, which follows serrated zone 504. Worm shaft 502, respectively its zone of large diameter 506 is introduced with a clearance fit into stepped bore 426, namely a portion of latter having the first of the three successively decreasing diameters. Zone of large diameter 506 of worm shaft 502 is provided with a circular notch 508 wherein a second O-ring seal 510 is inserted. Thus, a barrier preventing a water or mist infiltration between worm shaft 502 and stepped bore 426, from beneath to above second O-ring seal 510, is formed. Zone of large diameter 506 is supported in stepped bore 426 by a shoulder formed at a transition between first and second diameters of the three successively decreasing diameters of stepped bore 426.

Worm shaft 502 includes as well a worm zone 512, made integral with it and following zone of large diameter 506. Worm zone 512 is so positioned on worm shaft 502 that it faces the pair of inclined slots 428.

Finally, worm shaft 502 is provided with a guiding-retaining zone 514 mounted with a close-running fit into the last of the three successively decreasing diameters of stepped bore 426. Guiding-retaining zone 514 extends beyond an end of stepped bore 426 where it is provided with an annular indentation 516. An external retaining ring 518 is inserted into annular indentation 516. Thus, worm shaft 502 is only enabled to rotate; any axial movement is prevented by both: the shoulder formed at the transition between first and second diameters of the three successively decreasing diameters of stepped bore 426, and external retaining ring 518. Interconnecting mechanism 600 basically comprises

- a left and right worm gear arms 602 and respectively 602', located partially in housing 400, where they are pivotally secured, and interconnected outside housing 400 with
- a left and right links 604 and respectively 604', both pivotally secured further to
- a closing link 606 removably connected to
- an attachment fixture 607 that is firmly secured to second edge 210 of sash 200.

Referring now in detail, both left and right worm gear arms 602 and 602' terminate, at one extremity, in a worm gear 608, specifically a segment of the latter, drivably engaged with worm shaft 502, and at an opposite extremity—in a male end 610, or, alternatively, in a female end 612. Male end 610 is similar to a calotte of a sphere, while female end 612 is similar to a spherical shaped recess that is complementary to the calotte of a sphere. Male end 610 is centrally provided with a first stepped passage 614 that is, generally, larger in diameter than the diameter of a second stepped passage 616, centrally provided in female end 612. First stepped passage 614 is provided at its entrance, which is oppositely located relative to a contact zone between the calotte of a sphere and the spherical shaped recess, with a spherical indentation 614'. Second stepped passage 616 is provided at its exit, which is oppositely located relative to a contact zone between the calotte of a sphere and the spherical shaped recess, with a chamfered zone 616'.

Since each worm gear 608, which meshes with worm shaft 502, is actuated by the latter, the former is provided with a central aperture 618, coaxial with a perforation 432. A pin 620 inserted through each central aperture 618 and each perforation 432 enables both left and right worm gear arms 602 and 602' to be pivotally secured to housing 400. Both left and right worm gear arms 602 and 602' have such a thickness that allows them to freely move between the pair of internal parallel surfaces 412 and the pairs of guiding walls 416 and to be supported by the former and the latter.

Both left and right links 604 and respectively 604' terminate, at one extremity, in a in a male or female end 610 or 612, respectively.

It is evident when a left or a right worm gear arms 602 or respectively 602', extends outside housing into a male end 610, a female end 612 belonging to left and right links 604 or respectively 604' will complement it, and, vice versa. A stepped rivet 622, having a spherical head 622' to fit into spherical indentation 614', is provided with a relatively larger diameter for passing with a clearance through first stepped passage 614, and with a relatively smaller diameter for close fit into second stepped passage 616.

When stepped rivet 622 is used to assembly a male end 610 with a female end 612, an end of the stepped rivet 622 that protrudes from stepped passage 616 is upset. Thus, chamfered zone 616' will be filled with a closing end of stepped rivet 622 and a tightening of stepped rivet 622 should be so, that a relative movement between male end 610, namely its calotte of a sphere, and female end 612 can occur.

Both left and right links 604 and respectively 604' terminate, at another extremity, in a circular hole 624.

Closing link 606 incorporates at each extremity a circular hole 624 commensurate in size and axially coinciding with circular hole 624 of left and right links 604 and 604'. Rivets 626 for pivotally joining left and right links 604 and 604' to closing link 606 are inserted into circular holes 624 and 624' and then riveted.

Closing link 606 is further provided with a pair of long, narrow grooves 628, symmetrically spaced with respect its center of symmetry. Between the pair of long, narrow grooves 628 there is located a two-arm knob 630 pivotally connected to closing link 606.

Attachment fixture 607, which is of well known design, includes an elongated plate 632 provided with two outwardly and perpendicularly projecting arms 634, terminating with a pair of relatively short, turned ends 636. The latter, when closing link 606 is assembled with elongated plate 632, penetrates long, narrow groves 628. In order to prevent the pair of relatively short turned ends 636 to escape from long, narrow groves 628, two-arm knob 630 is rotated in one direction. In order to detach closing link 606 from attachment fixture 607, two-arm knob 630 is rotated in an opposed direction so that the pair of relatively short turned ends 636 could be removed from long, narrow groves 628.

Fasteners (not shown) are used to attach attachment fixture 607, respectively its elongated plate 632, to second edge 210 of sash 200.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

What we claim is:

1. An operator for a casement window comprising a housing attachable to a frame of the window;

a drive mechanism, generally disposed in said housing;

an interconnecting mechanism;

an attachment fixture adaptable to be secured to a sash of the window;

said drive mechanism and said attachment fixture being joined via said interconnecting mechanism;

said housing comprising a body with a pair of parallel walls and a closing wall closing a top of said body, said pair of parallel walls ending at a bottom of said body at a flange of said body extending perpendicular to said pair of parallel walls, an interior of said body including a pair of internal parallel surfaces, said flange having, at an end of said pair of parallel surfaces, a pair of consecutive slots; a pair of guiding walls extending outwardly from said flange and longitudinally along each side of a center of symmetry of said flange, so that each one of said pair of consecutive slots is flanked by two of said guiding walls, said guiding walls forming two consecutive channels; a first means for sealing being disposed in a continuous groove formed in and extending around said flange; a, inclined with respect to said flange and projecting outwardly from one of said pair of parallel walls said turret, being provided with a stepped bore having successively decreasing diameters and inclined slots for communicating with said interior of said booty;

said drive mechanism including a worm shaft inserted with a clearance fit into said stepped bore, a portion of said worm shaft, corresponding to its largest diameter, being provided with a notch, a second means for sealing is located, in said notch; and said interconnecting mechanism comprising two worm gear arms pivotally secured to and located partially in said housing, wherein said gear arms engage said worm shaft at a first end of said arms and are pivotally interconnected with two closing links at a second end of said arms each of said two worm gear arms having at said first end a segment of a worm gear drivably engaged with said worm shaft, each of said gear arms having at said second end thereof one of a male end and a female end pivotally connected to one of a female end and a male end of a respective one of said closing links.

2. The operator, as defined in claim 1, wherein said housing further comprises a base having a length generally equal to a length of with said flange and provided with a guiding slot, said body and said base being adapted to sandwich the frame of the window, wherein said first means for sealing comprises an O-ring seal.

3. The operator, as defined in claim 1, wherein said portion of said worm shaft with the largest diameter is supported in said stepped bore by a shoulder of said stepped bore said worm shaft further including a worm zone and a guiding-retaining zone, said guiding-retaining zone extends past an end of said stepped bore and is provided with an annular indentation for locating a retaining ring.

4. The operator, as defined in claim 1, wherein said male ends are generally shaped as a calotte of a sphere, and said female ends have a spherical shaped recess that is complementary to said calotte of a sphere, wherein said worm gear arms are connected to said closing links via a stepped rivet.

* * * * *